US008017072B2

(12) United States Patent
Pandey

(10) Patent No.: US 8,017,072 B2
(45) Date of Patent: Sep. 13, 2011

(54) DISPERSION STRENGTHENED $L1_2$ ALUMINUM ALLOYS

(75) Inventor: Awadh B. Pandey, Jupiter, FL (US)

(73) Assignee: United Technologies Corporation, Hartford, CT (US)

( * ) Notice: Subject to any disclaimer, the term of this patent is extended or adjusted under 35 U.S.C. 154(b) by 857 days.

(21) Appl. No.: 12/148,432

(22) Filed: Apr. 18, 2008

(65) Prior Publication Data

US 2009/0263277 A1 Oct. 22, 2009

(51) Int. Cl.
*C22C 21/00* (2006.01)

(52) U.S. Cl. ..... 420/550; 420/551; 148/415; 148/437

(58) Field of Classification Search ..... 420/542, 420/543, 547, 550, 551; 148/415, 437, 440
See application file for complete search history.

(56) References Cited

U.S. PATENT DOCUMENTS

| | | | |
|---|---|---|---|
| 3,619,181 | A | 11/1971 | Willey |
| 3,816,080 | A | 6/1974 | Bomford et al. |
| 4,041,123 | A | 8/1977 | Lange et al. |
| 4,259,112 | A | 3/1981 | Dolowy, Jr. et al. |
| 4,463,058 | A | 7/1984 | Hood et al. |
| 4,469,537 | A | 9/1984 | Ashton et al. |
| 4,499,048 | A | 2/1985 | Hanejko |
| 4,597,792 | A | 7/1986 | Webster |
| 4,626,294 | A | 12/1986 | Sanders, Jr. |
| 4,647,321 | A | 3/1987 | Adam |
| 4,661,172 | A | 4/1987 | Skinner et al. |
| 4,667,497 | A | 5/1987 | Oslin et al. |
| 4,689,090 | A | 8/1987 | Sawtell et al. |
| 4,710,246 | A | 12/1987 | Le Caer et al. |
| 4,713,216 | A | 12/1987 | Higashi et al. |
| 4,755,221 | A | 7/1988 | Paliwal et al. |
| 4,853,178 | A | 8/1989 | Oslin |
| 4,865,806 | A | 9/1989 | Skibo et al. |
| 4,874,440 | A | 10/1989 | Sawtell et al. |
| 4,915,605 | A | 4/1990 | Chan et al. |
| 4,927,470 | A | 5/1990 | Cho |
| 4,933,140 | A | 6/1990 | Oslin |
| 4,946,517 | A | 8/1990 | Cho |
| 4,964,927 | A | 10/1990 | Shiflet et al. |

(Continued)

FOREIGN PATENT DOCUMENTS

CN 1436870 A 8/2003

(Continued)

OTHER PUBLICATIONS

A.B. Pandey et al, High Strength Discontinuously Reinforced Aluminum for Rocket Applications, in Affordable Metal Matrix Composites for High Performance Applications II, ed. A.B. Pandey et al, TMS, 2003, p. 3-12.*

(Continued)

*Primary Examiner* — George Wyszomierski
*Assistant Examiner* — Mark L Shevin
(74) *Attorney, Agent, or Firm* — Kinney & Lange, P.A.

(57) ABSTRACT

An improved $L1_2$ aluminum alloy having magnesium or nickel; at least one of scandium, erbium, thulium, ytterbium, and lutetium; at least one of gadolinium, yttrium, zirconium, titanium, hafnium, and niobium; and at least one ceramic reinforcement. Aluminum oxide, silicon carbide, aluminum nitride, titanium boride, titanium diboride and titanium carbide are suitable ceramic reinforcement particles. These alloys derive strengthening from mechanisms based on dislocation-particle interaction and load transfer to stiffen reinforcements.

13 Claims, 7 Drawing Sheets

U.S. PATENT DOCUMENTS

| | | | | |
|---|---|---|---|---|
| 4,988,464 | A | 1/1991 | Riley | |
| 5,032,352 | A | 7/1991 | Meeks et al. | |
| 5,053,084 | A | 10/1991 | Masumoto et al. | |
| 5,055,257 | A * | 10/1991 | Chakrabarti et al. | 148/564 |
| 5,059,390 | A | 10/1991 | Burleigh et al. | |
| 5,066,342 | A | 11/1991 | Rioja et al. | |
| 5,076,340 | A | 12/1991 | Bruski et al. | |
| 5,076,865 | A | 12/1991 | Hashimoto et al. | |
| 5,130,209 | A | 7/1992 | Das et al. | |
| 5,133,931 | A | 7/1992 | Cho | |
| 5,198,045 | A | 3/1993 | Cho et al. | |
| 5,211,910 | A | 5/1993 | Pickens et al. | |
| 5,226,983 | A | 7/1993 | Skinner et al. | |
| 5,256,215 | A | 10/1993 | Horimura | |
| 5,308,410 | A | 5/1994 | Horimura et al. | |
| 5,312,494 | A | 5/1994 | Horimura et al. | |
| 5,318,641 | A | 6/1994 | Masumoto et al. | |
| 5,397,403 | A | 3/1995 | Horimura et al. | |
| 5,458,700 | A | 10/1995 | Masumoto et al. | |
| 5,462,712 | A | 10/1995 | Langan et al. | |
| 5,480,470 | A | 1/1996 | Miller et al. | |
| 5,597,529 | A | 1/1997 | Tack | |
| 5,620,652 | A | 4/1997 | Tack et al. | |
| 5,624,632 | A | 4/1997 | Baumann et al. | |
| 5,882,449 | A | 3/1999 | Waldron et al. | |
| 6,139,653 | A | 10/2000 | Fernandes et al. | |
| 6,149,737 | A | 11/2000 | Hattori et al. | |
| 6,248,453 | B1 * | 6/2001 | Watson | 428/614 |
| 6,254,704 | B1 | 7/2001 | Laul et al. | |
| 6,258,318 | B1 | 7/2001 | Lenczowski et al. | |
| 6,309,594 | B1 | 10/2001 | Meeks, III et al. | |
| 6,312,643 | B1 | 11/2001 | Upadhya et al. | |
| 6,315,948 | B1 | 11/2001 | Lenczowski et al. | |
| 6,331,218 | B1 | 12/2001 | Inoue et al. | |
| 6,355,209 | B1 | 3/2002 | Dilmore et al. | |
| 6,368,427 | B1 | 4/2002 | Sigworth | |
| 6,506,503 | B1 | 1/2003 | Mergen et al. | |
| 6,517,954 | B1 | 2/2003 | Mergen et al. | |
| 6,524,410 | B1 | 2/2003 | Kramer et al. | |
| 6,531,004 | B1 | 3/2003 | Lenczowski et al. | |
| 6,562,154 | B1 | 5/2003 | Rioja et al. | |
| 6,630,008 | B1 | 10/2003 | Meeks, III et al. | |
| 6,702,982 | B1 | 3/2004 | Chin et al. | |
| 6,902,699 | B2 | 6/2005 | Fritzemeier et al. | |
| 6,918,970 | B2 | 7/2005 | Lee et al. | |
| 6,974,510 | B2 | 12/2005 | Watson | |
| 7,048,815 | B2 | 5/2006 | Senkov et al. | |
| 7,097,807 | B1 | 8/2006 | Meeks, III et al. | |
| 7,241,328 | B2 | 7/2007 | Keener | |
| 7,344,675 | B2 | 3/2008 | Van Daam et al. | |
| 2001/0054247 | A1 | 12/2001 | Stall et al. | |
| 2003/0192627 | A1 | 10/2003 | Lee et al. | |
| 2004/0046402 | A1 | 3/2004 | Winardi | |
| 2004/0055671 | A1 | 3/2004 | Olson et al. | |
| 2004/0089382 | A1 | 5/2004 | Senkov et al. | |
| 2004/0170522 | A1 | 9/2004 | Watson | |
| 2004/0191111 | A1 | 9/2004 | Nie et al. | |
| 2005/0147520 | A1 | 7/2005 | Canzona | |
| 2006/0011272 | A1 | 1/2006 | Lin et al. | |
| 2006/0093512 | A1 * | 5/2006 | Pandey | 420/528 |
| 2006/0172073 | A1 | 8/2006 | Groza et al. | |
| 2006/0269437 | A1 | 11/2006 | Pandey | |
| 2007/0048167 | A1 | 3/2007 | Yano | |
| 2007/0062669 | A1 | 3/2007 | Song et al. | |
| 2008/0066833 | A1 | 3/2008 | Lin et al. | |

FOREIGN PATENT DOCUMENTS

| | | | |
|---|---|---|---|
| CN | 101205578 | A | 6/2008 |
| EP | 0 208 631 | A1 | 6/1986 |
| EP | 0 584 596 | A2 | 2/1994 |
| EP | 1 111 079 | A1 | 6/2001 |
| EP | 1 249 303 | A1 | 10/2002 |
| EP | 1 170 394 | B1 | 4/2004 |
| EP | 1 439 239 | | 7/2004 |
| EP | 1 471 157 | A1 | 10/2004 |
| EP | 1 111 078 | | 6/2006 |
| EP | 1 728 881 | | 12/2006 |
| EP | 1 788 102 | | 5/2007 |
| FR | 2 656 629 | A1 | 12/1989 |
| FR | 2843754 | A1 | 2/2004 |
| JP | 2004 218638 | A | 12/1990 |
| JP | 9104940 | A | 4/1997 |
| JP | 9279284 | A | 10/1997 |
| JP | 11156584 | A | 6/1999 |
| JP | 2000119786 | A | 4/2000 |
| JP | 2001038442 | A | 2/2001 |
| JP | 2007 188878 | A | 7/2007 |
| RU | 2001144 | C1 | 10/1993 |
| WO | 90/02620 | | 3/1990 |
| WO | 91 10755 | A2 | 7/1991 |
| WO | 91 11540 | A1 | 8/1991 |
| WO | 9532074 | A2 | 11/1995 |
| WO | WO 96/10099 | | 4/1996 |
| WO | 9833947 | A1 | 8/1998 |
| WO | 00/37696 | | 6/2000 |
| WO | 02 29139 | A2 | 4/2002 |
| WO | 03 052154 | A1 | 6/2003 |
| WO | 03085145 | A2 | 10/2003 |
| WO | 03085146 | A1 | 10/2003 |
| WO | 03 104505 | A2 | 12/2003 |
| WO | 2004 005562 | A2 | 1/2004 |
| WO | 2004046402 | A2 | 6/2004 |
| WO | 2005 045080 | A1 | 5/2005 |
| WO | 2005 047554 | A1 | 5/2005 |

OTHER PUBLICATIONS

Cook, R., et al. "Aluminum and Aluminum Alloy Powders for P/M Applications." The Aluminum Powder Company Limited, Ceracon Inc.

"Aluminum and Aluminum Alloys." ASM Specialty Handbook. 1993. ASM International. p. 559.

ASM Handbook, vol. 7 ASM International, Materials Park, OH (1993) p. 396.

Gangopadhyay, A.K., et al. "Effect of rare-earth atomic radius on the devitrification of AI88RE8Ni4 amorphous alloys." Philosophical Magazine A, 2000, vol. 80, No. 5, pp. 1193-1206.

Riddle, Y.W., et al. "Improving Recrystallization Resistance in WRought Aluminum Alloys with Scandium Addition." Lightweight Alloys for Aerospace Applications VI (pp. 26-39), 2001 TMS Annual Meeting, New Orleans, Louisiana, Feb. 11-15, 2001.

Baikowski Malakoff Inc. "The many uses of High Purity Alumina." Technical Specs. http://www.baikowskimalakoff.com/pdf/Rc-Ls.pdf (2005).

Lotsko, D.V., et al. "Effect of small additions of transition metals on the structure of Al-Zn-Mg-Zr-Sc alloys." New Level of Properties. Advances in Insect Physiology. Academic Press, vol. 2, Nov. 4, 2002. pp. 535-536.

Neikov, O.D., et al. "Properties of rapidly solidified powder aluminum alloys for elevated temperatures produced by water atomization." Advances in Powder Metallurgy & Particulate Materials. 2002. pp. 7-14-7-27.

Harada, Y. et al. "Microstructure of Al3Sc with ternary transition-metal additions." Materials Science and Engineering A329-331 (2002) 686-695.

Unal, A. et al. "Gas Atomization" from the section "Production of Aluminum and Aluminum-Alloy Powder" ASM Handbook, vol. 7. 2002.

Riddle, Y.W., et al. "A Study of Coarsening, Recrystallization, and Morphology of Microstructure in Al—Sc—(Zr)—(Mg) Alloys." Metallurgical and Materials Transactions A. vol. 35A, Jan. 2004. pp. 341-350.

Mil'Man, Y.V. et al. "Effect of Additional Alloying with Transition Metals on the STructure of an Al-7.1 Zn-1.3 Mg-0.12 Zr Alloy." Metallofizika I Noveishie Teknohologii, 26 (10), 1363-1378, 2004.

Tian, N. et al. "Heating rate dependence of glass transition and primary crystallization of Al88Gd6Er2Ni4 metallic glass." Scripta Materialia 53 (2005) pp. 681-685.

Litynska, L. et al. "Experimental and theoretical characterization of AI3Sc precipitates in Al—Mg—Si—Cu—Sc—Zr alloys." Zeitschrift Fur Metallkunde. vol. 97, No. 3. Jan. 1, 2006. pp. 321-324.

Rachek, O.P. "X-ray diffraction study of amorphous alloys Al—Ni—Ce—Sc with using Ehrenfest's formula." Journal of Non-Crystalline Solids 352 (2006) pp. 3781-3786.
Niu, Ben et al. "Influence of addition of 1-15 erbium on microstructure and crystallization behavior of Al—Ni—Y amorphous alloy" Zhongguo Xitu Xuebao, 26(4), pp. 450-454. 2008.
Riddle, Y.W., et al. "Recrystallization Performance of AA7050 Varied with Sc and Zr." Materials Science Forum. 2000. pp. 799-804.
Lotsko, D.V., et al. "High-strength aluminum-based alloys hardened by quasicryatalline nanoparticles." Science for Materials in the Frontier of Centuries: Advantages and Challenges, International Conference: Kyiv, Ukraine. Nov. 4-8, 2002. vol. 2. pp. 371-372.
Hardness Conversion Table. Downloaded from http://www.gordonengland.co.uk/hardness/hardness_conversion_2m.htm.
European Search Report—EP 09 25 1015—Dated Jun. 30, 2009—8 pages.
Pandey A B et al, "High Strength Discontinuously Reinforced Aluminum for Rocket Applications," Affordable Metal Matrix Composites for High Performance Applications. Symposia Proceedings, TMS (The Minerals, Metals & Materials Society), US, No. 2nd, Jan. 1, 2008, pp. 3-12.

* cited by examiner

DISPERSION STRENGTHENED $L1_2$ ALUMINUM ALLOYS

CROSS-REFERENCE TO RELATED APPLICATIONS

This application is related to the following co-pending applications that are filed on even date herewith and are assigned to the same assignee: $L1_2$ ALUMINUM ALLOYS WITH BIMODAL AND TRIMODAL DISTRIBUTION, Ser. No. 12/148,395, HEAT TREATABLE $L1_2$ ALUMINUM ALLOYS, Ser. No. 12/148,383, HIGH STRENGTH $L1_2$ ALUMINUM ALLOYS, Ser. No. 12/148,394, HIGH STRENGTH $L1_2$ ALUMINUM ALLOYS, Ser. No. 12/148,382, HEAT TREATABLE $L1_2$ ALUMINUM ALLOYS, Ser. No. 12/148,396, HIGH STRENGTH $L1_2$ ALUMINUM ALLOYS, Ser. No. 12/148,387, HIGH STRENGTH ALUMINUM ALLOYS WITH $L1_2$ PRECIPITATES, Ser. No. 12/148,426, HIGH STRENGTH $L1_2$ ALUMINUM ALLOYS, Ser. No. 12/148,459, and $L1_2$ STRENGTHENED AMORPHOUS ALUMINUM ALLOYS, Ser. No. 12/148,458.

BACKGROUND

The present invention relates generally to aluminum alloys and more specifically to $L1_2$ phase dispersion strengthened aluminum alloys having ceramic reinforcement particles. The combination of high strength, ductility, and fracture toughness, as well as low density, make aluminum alloys natural candidates for aerospace and space applications. However, their use is typically limited to temperatures below about 300° F. (149° C.) since most aluminum alloys start to lose strength in that temperature range as a result of coarsening of strengthening precipitates.

The development of aluminum alloys with improved elevated temperature mechanical properties is a continuing process. Some attempts have included aluminum-iron and aluminum-chromium based alloys such as Al—Fe—Ce, Al—Fe—V—Si, Al—Fe—Ce—W, and Al—Cr—Zr—Mn that contain incoherent dispersoids. These alloys, however, also lose strength at elevated temperatures due to particle coarsening. In addition, these alloys exhibit ductility and fracture toughness values lower than other commercially available aluminum alloys.

Other attempts have included the development of mechanically alloyed Al—Mg and Al—Ti alloys containing ceramic dispersoids. These alloys exhibit improved high temperature strength due to the particle dispersion, but the ductility and fracture toughness are not improved.

U.S. Pat. No. 6,248,453 discloses aluminum alloys strengthened by dispersed $Al_3X$ $L1_2$ intermetallic phases where X is selected from the group consisting of Sc, Er, Lu, Yb, Tm, and U. The $Al_3X$ particles are coherent with the aluminum alloy matrix and are resistant to coarsening at elevated temperatures. The improved mechanical properties of the disclosed dispersion strengthened $L1_2$ aluminum alloys are stable up to 572° F. (300° C.). In order to create aluminum alloys containing fine dispersions of $Al_3X$ $L1_2$ particles, the alloys need to be manufactured by expensive rapid solidification processes with cooling rates in excess of $1.8\times10^3$ F/sec ($10^{3}$° C./sec). U.S. Patent Application Publication No. 2006/0269437 A1 discloses an aluminum alloy that contains scandium and other elements. While the alloy is effective at high temperatures, it is not capable of being heat treated using a conventional age hardening mechanism.

It is desirable for aluminum alloys with $L1_2$ precipitates to have balanced mechanical properties suitable for high performance applications. Scandium forms an $Al_3Sc$ precipitate in aluminum alloys that is strong and thermally stable. The addition of gadolinium and zirconium improves thermal stability of the alloy by substitution of gadolinium and zirconium into the $Al_3Sc$ precipitate. This alloy has high strength for a wide temperature range of −423° F. (−253° C.) up to about 600° F. (316° C.). It would be desirable to increase the strength and modulus of dispersion strengthened $L1_2$ aluminum alloys at room temperature and elevated temperatures by increasing resistance to dislocation movement and by transferring load to stiffer reinforcements.

SUMMARY

The present invention is an improved $L1_2$ aluminum alloy with the addition of ceramic reinforcements to further increase strength and modulus of the material. Aluminum oxide, silicon carbide, aluminum nitride, titanium boride, titanium diboride and titanium carbide are suitable ceramic reinforcements. Strengthening in these alloys is derived from Orowan strengthening where dislocation movement is restricted due to individual interaction between dislocation and the reinforced particle.

In order to be effective, the reinforcing ceramic particles need to have fine size, moderate volume fraction and good interface between the matrix and reinforcement. Reinforcements can have average particle sizes of about 0.5 to about 50 microns, more preferably about 1 to about 20 microns, and even more preferably about 1 to about 20, and even more preferably about 1 to about 10 microns. These fine particles located at the grain boundary and within the grain boundary will restrict the dislocation from going around particles. The dislocations become attached with particles on the departure side, and thus require more energy to detach the dislocation.

DETAILED DESCRIPTION

The alloys of this invention are based on the aluminum magnesium or aluminum nickel systems. The amount of magnesium in these alloys ranges from about 1 to about 8 weight percent, more preferably about 3 to about 7.5 weight percent, and even more preferably about 4 to about 6.5 weight percent. The amount of nickel in these alloys ranges from about 1 to about 10 weight percent, more preferably about 3 to about 9 weight percent, and even more preferably about 4 to about 9 weight percent.

Figure 1:
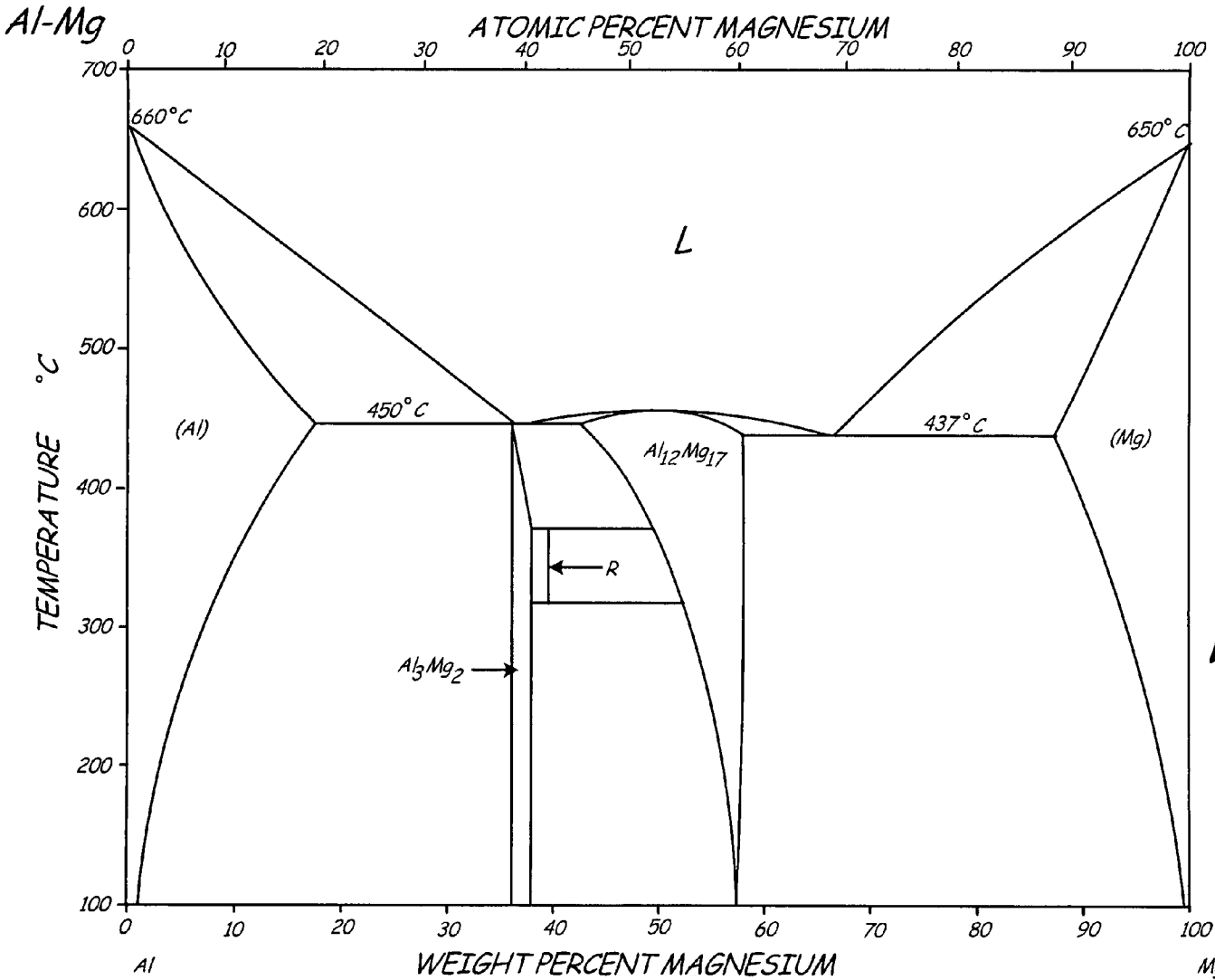
FIG. 1 is an aluminum magnesium phase diagram.

The aluminum magnesium phase diagram is shown in FIG. 1. The binary system is a eutectic alloy system with a eutectic reaction at 36 weight percent magnesium and 842° F. (450° C.). Magnesium has maximum solid solubility of 16 weight percent in aluminum at 842° F. (450° C.) which can extended further by rapid solidification processing. Magnesium provides substantial solid solution strengthening in aluminum. In addition, magnesium provides considerable increase in lattice parameter of aluminum matrix, which improves high temperature strength by reducing coarsening of precipitates.

Figure 2:
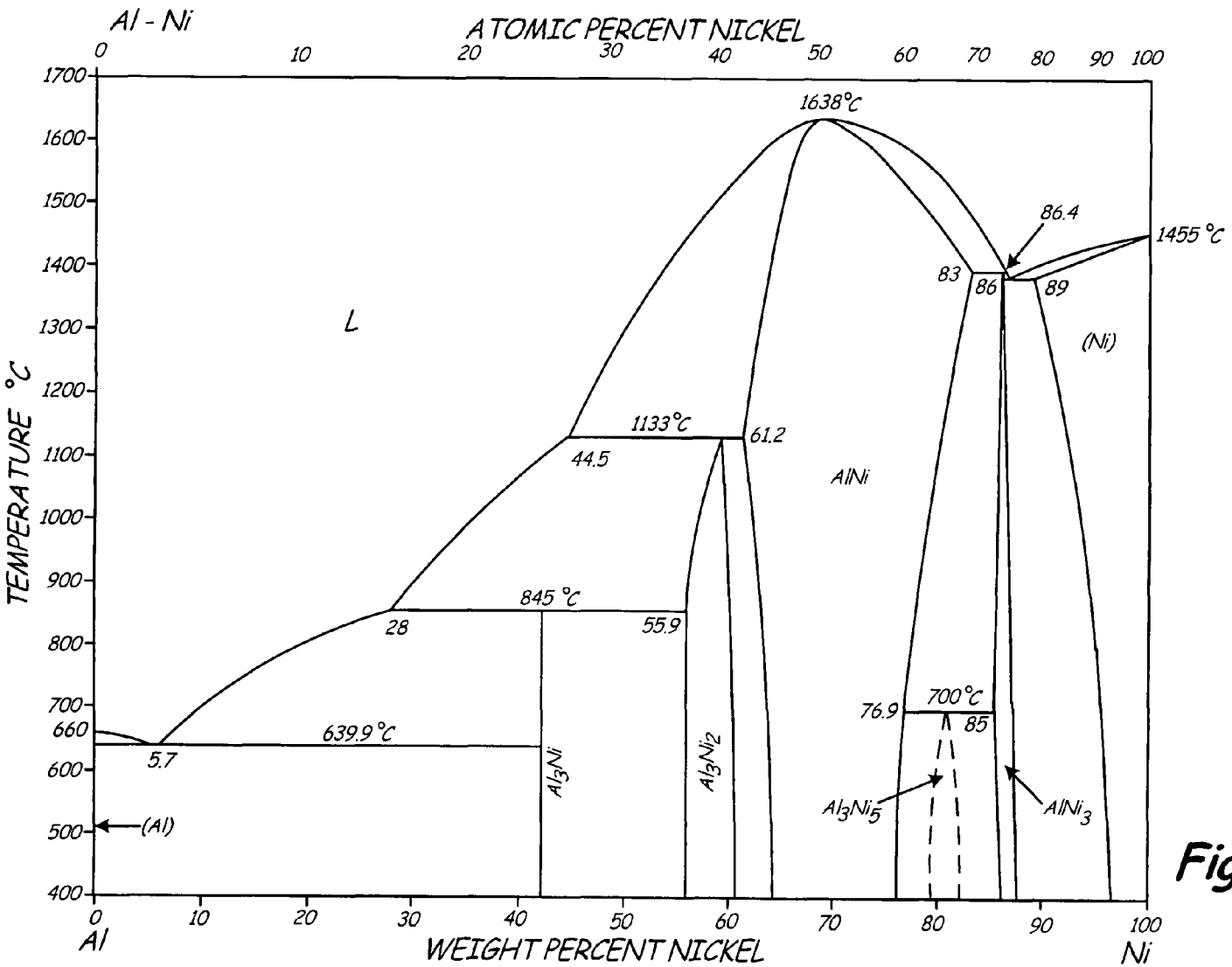
FIG. 2 is an aluminum nickel phase diagram.

The aluminum nickel phase diagram is shown in FIG. 2. The binary system is a eutectic alloy system with a eutectic reaction at about 5.5 weight percent nickel and 1183.8° F. (639.9° C.) resulting in a eutectic mixture of aluminum solid solution and $Al_3Ni$. Nickel has maximum solid solubility of less than 1 weight percent in aluminum at 1183.8° F. (639.9° C.) which can be extended further by rapid solidification processing. Nickel provides considerable dispersion strengthening in aluminum from precipitation of $Al_3Ni$ particles. In addition, nickel provides solid solution strengthening in aluminum. Nickel has a very low diffusion coefficient in aluminum, thus nickel can provide improved thermal stability.

The alloys of this invention contain phases consisting of primary aluminum, aluminum magnesium solid solutions and aluminum nickel solid solutions. In the solid solutions are dispersions of $Al_3X$ having an $L1_2$ structure where X is at least one element selected from scandium, erbium, thulium, ytterbium, and lutetium. Also present is at least one element selected from gadolinium, yttrium, zirconium, titanium, hafnium, and niobium.

The alloys may also include at least one ceramic reinforcement. Aluminum oxide, silicon carbide, boron carbide, aluminum nitride, titanium boride, titanium diboride and titanium carbide are suitable ceramic reinforcements.

The alloys may also optionally contain at least one element selected from zinc, copper, lithium and silicon to produce additional precipitation strengthening. The amount of zinc in these alloys ranges from about 3 to about 12 weight percent, more preferably about 4 to about 10 weight percent, and even more preferably about 5 to about 9 weight percent. The amount of copper in these alloys ranges from about 0.2 to about 3 weight percent, more preferably about 0.5 to about 2.5 weight percent, and even more preferably about 1 to about 2.5 weight percent. The amount of lithium in these alloys ranges from about 0.5 to about 3 weight percent, more preferably about 1 to about 2.5 weight percent, and even more preferably about 1 to about 2 weight percent. The amount of silicon in these alloys ranges from about 4 to about 25 weight percent silicon, more preferably about 4 to about 18 weight percent, and even more preferably about 5 to about 11 weight percent.

Exemplary aluminum alloys of this invention include, but are not limited to (in weight percent):

about Al-(1-8)Mg-(0.1-0.5)Sc-(0.1-4)Gd-(5-40 vol. %)$Al_2O_3$;
about Al-(1-8)Mg-(0.1-6)Er-(0.1-4)Gd-(5-40 vol. %)$Al_2O_3$;
about Al-(1-8)Mg-(0.1-10)Tm-(0.1-4)Gd -(5-40 vol. %)$Al_2O_3$;
about Al-(1-8)Mg-(0.1-15)Yb-(0.1-4)Gd -(5-40 vol. %)$Al_2O_3$;
about Al-(1-8)Mg-(0.1-12)Lu-(0.1-4)Gd-(5-40 vol. %)$Al_2O_3$;
about Al-(1-8)Mg-(0.1-0.5)Sc-(0.1-4)Y-(5-40 vol. %)SiC;
about Al-(1-8)Mg-(0.1-6)Er-(0.1-4)Y-(5-40 vol. %)SiC;
about Al-(1-8)Mg-(0.1-10)Tm-(0.1-4)Y-(5-40 vol. %)SiC;
about Al-(1-8)Mg-(0.1-15)Yb-(0.1-4)Y-(5-40 vol. %)SiC;
about Al-(1-8)Mg-(0.1-12)Lu-(0.1-4)Y-(5-40 vol. %)SiC;
about Al-(1-8)Mg-(0.1-0.5)Sc-(0.05-1.0)Zr-(5-40 vol. %)$B_4C$;
about Al-(1-8)Mg-(0.1-6)Er-(0.05-1.0)Zr-(5-40 vol. %)$B_4C$;
about Al-(1-8)Mg-(0.1-1.5)Tm-(0.05-1.0)Zr-(5-40 vol. %)$B_4C$;
about Al-(1-8)Mg-(0.1-15)Yb-(0.05-1.0)Zr-(5-40 vol. %)$B_4C$;
about Al-(1-8)Mg-(0.1-12)Lu-(0.05-1.0)Zr-(5-40 vol. %)$B_4C$;
about Al-(1-8)Mg-(0.1-0.5)Sc-(0.05-2)Ti-(5-40 vol. %)TiB;
about Al-(1-8)Mg-(0.1-6)Er-(0.05-2)Ti-(5-40 vol. %)TiB;
about Al-(1-8)Mg-(0.1-10)Tm-(0.05-2)Ti-(5-40 vol. %)TiB;
about Al-(1-8)Mg-(0.1-15)Yb-(0.05-2)Ti-(5-40 vol. %)TiB;
about Al-(1-8)Mg-(0.1-12)Lu-(0.05-2)Ti-(5-40 vol. %)TiB;
about Al-(1-8)Mg-(0.1-0.5)Sc-(0.05-2)Hf-(5-40 vol. %)AlN;
about Al-(1-8)Mg-(0.1-6)Er-(0.05-2)Hf-(5-40 vol. %)AlN;
about Al-(1-8)Mg-(0.1-10)Tm-(0.05-2)Hf-(5-40 vol. %)AlN;
about Al-(1-8)Mg-(0.1-15)Yb-(0.05-2)Hf-(5-40 vol. %)AlN;
about Al-(1-8)Mg-(0.1-12)Lu-(0.05-2)Hf-(5-40 vol. %)AlN;
about Al-(1-8)Mg-(0.1-0.5)Sc-(0.05-2)Hf-(5-40 vol. %)TiC;
about Al-(1-8)Mg-(0.1-6)Er-(0.05-2)Hf-(5-40 vol. %)TiC;
about Al-(1-8)Mg-(0.1-10)Tm-(0.05-2)Hf-(5-40 vol. %)TiC;
about Al-(1-8)Mg-(0.1-15)Yb-(0.05-2)Hf-(5-40 vol. %)TiC;
about Al-(1-8)Mg-(0.1-12)Lu-(0.05-2)Hf-(5-40 vol. %)TiC;
about Al-(1-8)Mg-(0.1-0.5)Sc-(0.05-1)Nb-(5-40 vol. %)$TiB_2$;
about Al-(1-8)Mg-(0.1-6)Er-(0.05-1)Nb-(5-40 vol. %)$TiB_2$;
about Al-(1-8)Mg-(0.1-10)Tm-(0.05-1)Nb-(5-40 vol. %)$TiB_2$;
about Al-(1-8)Mg-(0.1-15)Yb-(0.05-1)Nb-(5-40 vol. %)$TiB_2$;
about Al-(1-8)Mg-(0.1-12)Lu-(0.05-1)Nb-(5-40 vol. %)$TiB_2$;
about Al-(1-10)Ni-(0.1-0.5)Sc-(0.1-4)Gd-(5-40 vol. %)$Al_2O_3$;
about Al-(1-10)Ni-(0.1-6)Er-(0.1-4)Gd-(5-40 vol. %)$Al_2O_3$;
about Al-(1-10)Ni-(0.1-10)Tm-(0.1-4)Gd-(5-40 vol. %)$Al_2O_3$;
about Al-(1-10)Ni-(0.1-15)Yb-(0.1-4)Gd-(5-40 vol. %)$Al_2O_3$;
about Al-(1-10)Ni-(0.1-12)Lu-(0.1-4)Gd-(5-40 vol. %)$Al_2O_3$;
about Al-(1-10)Ni-(0.1-0.5)Sc-(0.1-4)Y-(5-40 vol. %)SiC;
about Al-(1-10)Ni-(0.1-6)Er-(0.1-4)Y-(5-40 vol. %)SiC;
about Al-(1-10)Ni-(0.1-10)Tm-(0.1-4)Y-(5-40 vol. %)SiC;
about Al-(1-10)Ni-(0.1-15)Yb-(0.1-4)Y-(5-40 vol. %)SiC;
about Al-(1-10)Ni-(0.1-12)Lu-(0.1-4)Y-(5-40 vol. %)SiC;
about Al-(1-10)Ni-(0.1-0.5)Sc-(0.05-1.0)Zr-(5-40 vol. %)$B_4C$;
about Al-(1-10)Ni-(0.1-6)Er-(0.05-1.0)Zr-(5-40 vol. %)$B_4C$;
about Al-(1-10)Ni-(0.1-1.5)Tm-(0.05-1.0)Zr-(5-40 vol. %)$B_4C$;
about Al-(1-10)Ni-(0.1-15)Yb-(0.05-1.0)Zr-(5-40 vol. %)$B_4C$;

about Al-(1-10)Ni-(0.1-12)Lu-(0.05-1.0)Zr-(5-40 vol. %)$B_4C$;

about Al-(1-10)Ni-(0.1-0.5)Sc-(0.05-2)Ti-(5-40 vol. %)TiB;

about Al-(1-10)Ni-(0.1-6)Er-(0.05-2)Ti-(5-40 vol. %)TiB;

about Al-(1-10)Ni-(0.1-10)Tm-(0.05-2)Ti-(5-40 vol. %)TiB;

about Al-(1-10)Ni-(0.1-15)Yb-(0.05-2)Ti-(5-40 vol. %)TiB;

about Al-(1-10)Ni-(0.1-12)Lu-(0.05-2)Ti-(5-40 vol. %)TiB;

about Al-(1-10)Ni-(0.1-0.5)Sc-(0.05-2)Hf-(5-40 vol. %)AlN;

about Al-(1-10)Ni-(0.1-6)Er-(0.05-2)Hf-(5-40 vol. %)AlN;

about Al-(1-10)Ni-(0.1-10)Tm-(0.05-2)Hf-(5-40 vol. %)AlN;

about Al-(1-10)Ni-(0.1-15)Yb-(0.05-2)Hf-(5-40 vol. %)AlN;

about Al-(1-10)Ni-(0.1-12)Lu-(0.05-2)Hf-(5-40 vol. %)AlN;

about Al-(1-10)Ni-(0.1-0.5)Sc-(0.05-2)Hf-(5-40 vol. %)TiC;

about Al-(1-10)Ni-(0.1-6)Er-(0.05-2)Hf-(5-40 vol. %)TiC;

about Al-(1-10)Ni-(0.1-10)Tm-(0.05-2)Hf-(5-40 vol. %)TiC;

about Al-(1-10)Ni-(0.1-15)Yb-(0.05-2)Hf-(5-40 vol. %)TiC;

about Al-(1-10)Ni-(0.1-12)Lu-(0.05-2)Hf-(5-40 vol. %)TiC;

about Al-(1-10)Ni-(0.1-0.025)Sc-(0.05-1)Nb-(5-40 vol. %)$TiB_2$;

about Al-(1-10)Ni-(0.1-6)Er-(0.05-1)Nb-(5-40 vol. %)$TiB_2$;

about Al-(1-10)Ni-(0.1-10)Tm-(0.05-1)Nb-(5-40 vol. %)$TiB_2$;

about Al-(1-10)Ni-(0.1-15)Yb-(0.05-1)Nb-(5-40 vol. %)$TiB_2$; and about Al-(1-10)Ni-(0.1-12)Lu-(0.05-1)Nb-(5-40 vol. %)$TiB_2$.

In the inventive aluminum based alloys disclosed herein, scandium, erbium, thulium, ytterbium, and lutetium are potent strengtheners that have low diffusivity and low solubility in aluminum. All these element form equilibrium $Al_3X$ intermetallic dispersoids where X is at least one of scandium, erbium, ytterbium, lutetium, that have an $L1_2$ structure that is an ordered face centered cubic structure with the X atoms located at the corners and aluminum atoms located on the cube faces of the unit cell.

Scandium forms $Al_3Sc$ dispersoids that are fine and coherent with the aluminum matrix. Lattice parameters of aluminum and $Al_3Sc$ are very close (0.405 nm and 0.410 nm respectively), indicating that there is minimal or no driving force for causing growth of the $Al_3Sc$ dispersoids. This low interfacial energy makes the $Al_3Sc$ dispersoids thermally stable and resistant to coarsening up to temperatures as high as about 842° F. (450° C.). In the alloys of this invention these $Al_3Sc$ dispersoids are made stronger and more resistant to coarsening at elevated temperatures by adding suitable alloying elements such as gadolinium, yttrium, zirconium, titanium, hafnium, niobium, or combinations thereof, that enter $Al_3Sc$ in solution.

Erbium forms $Al_3Er$ dispersoids in the aluminum matrix that are fine and coherent with the aluminum matrix. The lattice parameters of aluminum and $Al_3Er$ are close (0.405 nm and 0.417 nm respectively), indicating there is minimal driving force for causing growth of the $Al_3Er$ dispersoids. This low interfacial energy makes the $Al_3Er$ dispersoids thermally stable and resistant to coarsening up to temperatures as high as about 842° F. (450° C.). Additions of magnesium in solid solution in aluminum increase the lattice parameter of the aluminum matrix, and decrease the lattice parameter mismatch further increasing the resistance of the $Al_3Er$ to coarsening. Additions of copper increase the strength of alloys through precipitation of $Al_2Cu$ (θ') and $Al_2CuMg$ (S') phases. In the alloys of this invention, these $Al_3Er$ dispersoids are made stronger and more resistant to coarsening at elevated temperatures by adding suitable alloying elements such as gadolinium, yttrium, zirconium, titanium, hafnium, niobium, or combinations thereof that enter $Al_3Er$ in solution.

Thulium forms metastable $Al_3Tm$ dispersoids in the aluminum matrix that are fine and coherent with the aluminum matrix. The lattice parameters of aluminum and $Al_3Tm$ are close (0.405 nm and 0.420 nm respectively), indicating there is minimal driving force for causing growth of the $Al_3Tm$ dispersoids. This low interfacial energy makes the $Al_3Tm$ dispersoids thermally stable and resistant to coarsening up to temperatures as high as about 842° F. (450° C.). Additions of magnesium in solid solution in aluminum increase the lattice parameter of the aluminum matrix, and decrease the lattice parameter mismatch further increasing the resistance of the $Al_3Tm$ to coarsening. Additions of copper increase the strength of alloys through precipitation of $Al_2Cu$ (θ') and $Al_2CuMg$ (S') phases. In the alloys of this invention these $Al_3Tm$ dispersoids are made stronger and more resistant to coarsening at elevated temperatures by adding suitable alloying elements such as gadolinium, yttrium, zirconium, titanium, hafnium, niobium, or combinations thereof that enter $Al_3Tm$ in solution.

Ytterbium forms $Al_3Yb$ dispersoids in the aluminum matrix that are fine and coherent with the aluminum matrix. The lattice parameters of Al and $Al_3Yb$ are close (0.405 nm and 0.420 nm respectively), indicating there is minimal driving force for causing growth of the $Al_3Yb$ dispersoids. This low interfacial energy makes the $Al_3Yb$ dispersoids thermally stable and resistant to coarsening up to temperatures as high as about 842° F. (450° C.). Additions of magnesium in solid solution in aluminum increase the lattice parameter of the aluminum matrix, and decrease the lattice parameter mismatch further increasing the resistance of the $Al_3Yb$ to coarsening. Additions of copper increase the strength of alloys through precipitation of $Al_2Cu$ (θ') and $Al_2CuMg$ (S') phases. In the alloys of this invention, these $Al_3Yb$ dispersoids are made stronger and more resistant to coarsening at elevated temperatures by adding suitable alloying elements such as gadolinium, yttrium, zirconium, titanium, hafnium, niobium, or combinations thereof that enter $Al_3Yb$ in solution.

Lutetium forms $Al_3Lu$ dispersoids in the aluminum matrix that are fine and coherent with the aluminum matrix. The lattice parameters of Al and $Al_3Lu$ are close (0.405 nm and 0.419 nm respectively), indicating there is minimal driving force for causing growth of the $Al_3Lu$ dispersoids. This low interfacial energy makes the $Al_3Lu$ dispersoids thermally stable and resistant to coarsening up to temperatures as high as about 842° F. (450° C.). Additions of magnesium in solid solution in aluminum increase the lattice parameter of the aluminum matrix, and decrease the lattice parameter mismatch further increasing the resistance of the $Al_3Lu$ to coarsening. Additions of copper increase the strength of alloys through precipitation of $Al_2Cu$ (θ') and $Al_2CuMg$ (S') phases. In the alloys of this invention, these $Al_3Lu$ dispersoids are made stronger and more resistant to coarsening at elevated temperatures by adding suitable alloying elements such as gadolinium, yttrium, zirconium, titanium, hafnium, niobium, or mixtures thereof that enter $Al_3Lu$ in solution.

Gadolinium forms metastable $Al_3Gd$ dispersoids in the aluminum matrix that are stable up to temperatures as high as about 842° F. (450° C.) due to their low diffusivity in aluminum. The $Al_3Gd$ dispersoids have a $D0_{19}$ structure in the equilibrium condition. Despite its large atomic size, gadolinium has fairly high solubility in the $Al_3X$ intermetallic dispersoids (where X is scandium, erbium, thulium, ytterbium or lutetium). Gadolinium can substitute for the X atoms in $Al_3X$ intermetallic, thereby forming an ordered $L1_2$ phase which results in improved thermal and structural stability.

Yttrium forms metastable $Al_3Y$ dispersoids in the aluminum matrix that have an $L1_2$ structure in the metastable condition and a $D0_{19}$ structure in the equilibrium condition. The metastable $Al_3Y$ dispersoids have a low diffusion coefficient which makes them thermally stable and highly resistant to coarsening. Yttrium has a high solubility in the $Al_3X$ intermetallic dispersoids allowing large amounts of yttrium to substitute for X in the $Al_3X$ $L1_2$ dispersoids which results in improved thermal and structural stability.

Zirconium forms $Al_3Zr$ dispersoids in the aluminum matrix that have an $L1_2$ structure in the metastable condition and $D0_{23}$ structure in the equilibrium condition. The metastable $Al_3Zr$ dispersoids have a low diffusion coefficient which makes them thermally stable and highly resistant to coarsening. Zirconium has a high solubility in the $Al_3X$ dispersoids allowing large amounts of zirconium to substitute for X in the $Al_3X$ dispersoids, which results in improved thermal and structural stability.

Titanium forms $Al_3Ti$ dispersoids in the aluminum matrix that have an $L1_2$ structure in the metastable condition and $DO_{22}$ structure in the equilibrium condition. The metastable $Al_3Ti$ despersoids have a low diffusion coefficient which makes them thermally stable and highly resistant to coarsening. Titanium has a high solubility in the $Al_3X$ dispersoids allowing large amounts of titanium to substitute for X in the $Al_3X$ dispersoids, which result in improved thermal and structural stability.

Hafnium forms metastable $Al_3Hf$ dispersoids in the aluminum matrix that have an $L1_2$ structure in the metastable condition and a $D0_{23}$ structure in the equilibrium condition. The $Al_3Hf$ dispersoids have a low diffusion coefficient, which makes them thermally stable and highly resistant to coarsening. Hafnium has a high solubility in the $Al_3X$ dispersoids allowing large amounts of hafnium to substitute for scandium, erbium, thulium, ytterbium, and lutetium in the above mentioned $Al_3X$ dispersoids, which results in stronger and more thermally stable dispersoids.

Niobium forms metastable $Al_3Nb$ dispersoids in the aluminum matrix that have an $L1_2$ structure in the metastable condition and a $D0_{22}$ structure in the equilibrium condition. Niobium has a lower solubility in the $Al_3X$ dispersoids than hafnium or yttrium, allowing relatively lower amounts of niobium than hafnium or yttrium to substitute for X in the $Al_3X$ dispersoids. Nonetheless, niobium can be very effective in slowing down the coarsening kinetics of the $Al_3X$ dispersoids because the $Al_3Nb$ dispersoids are thermally stable. The substitution of niobium for X in the above mentioned $Al_3X$ dispersoids results in stronger and more thermally stable dispersoids.

The aluminum oxide, silicon carbide, aluminum nitride, titanium di-boride, titanium boride and titanium carbide locate at the grain boundary and within the grain boundary to restrict dislocations from going around particles of the ceramic particles when the alloy is under stress. When dislocations form, they become attached with the ceramic particles on the departure side. Thus, more energy is required to detach the dislocation and the alloy has increased strength. To accomplish this, the particles of ceramic have to have a fine size, a moderate volume fraction in the alloy, and form a good interface between the matrix and the reinforcement. A working range of particle sizes is from about 0.5 to about 50 microns, more preferably about 1 to about 20 microns, and even more preferably about 1 to about 10 microns. The ceramic particles can break during blending and the average particle size will decrease as a result.

$Al_3X$ $L1_2$ precipitates improve elevated temperature mechanical properties in aluminum alloys for two reasons. First, the precipitates are ordered intermetallic compounds. As a result, when the particles are sheared by glide dislocations during deformation, the dislocations separate into two partial dislocations separated by an anti-phase boundary on the glide plane. The energy to create the anti-phase boundary is the origin of the strengthening. Second, the cubic $L1_2$ crystal structure and lattice parameter of the precipitates are closely matched to the aluminum solid solution matrix. This results in a lattice coherency at the precipitate/matrix boundary that resists coarsening. The lack of an interphase boundary results in a low driving force for particle growth and resulting elevated temperature stability. Alloying elements in solid solution in the dispersed strengthening particles and in the aluminum matrix that tend to decrease the lattice mismatch between the matrix and particles will tend to increase the strengthening and elevated temperature stability of the alloy.

The role of magnesium in these alloys is to provide solid solution strengthening as magnesium has substantial solid solubility in aluminum. In addition, magnesium increases the lattice parameter which helps in improving high temperature strength by reducing coarsening kinetics of alloy. Magnesium provides significant precipitation hardening in the presence of zinc, copper, lithium and silicon through formation of fine coherent second phases that includes $Zn_2Mg$, $Al_2CuMg$, $Mg_2Li$, and $Mg_2Si$.

The role of nickel in these alloys is to provide dispersion hardening through formation of fine second phase $Al_3Ni$. Nickel provides limited solid solution strengthening as solubility of nickel in aluminum is not significant. Nickel has low diffusion coefficient in aluminum which helps in reducing coarsening kinetics of alloy resulting in more thermally stable alloy. Nickel does not have much solubility in magnesium, zinc, copper, lithium and silicon or vice versa, therefore the presence of these additional elements with nickel provides additive contribution in strengthening through precipitation from heat treatment. The presence of magnesium with nickel provides solid solution hardening in addition to dispersion hardening.

Figure 3:
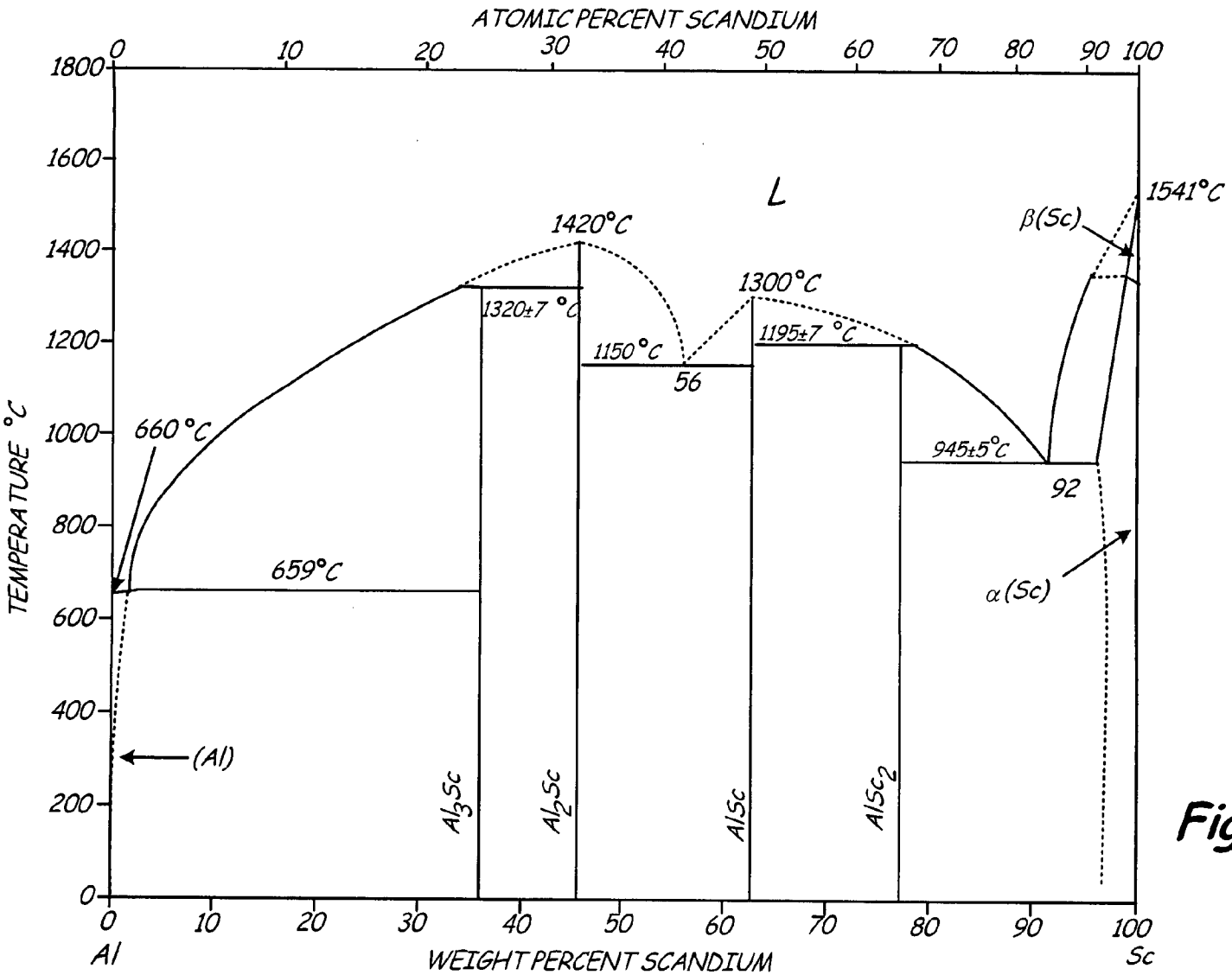
FIG. 3 is an aluminum scandium phase diagram.

The amount of scandium present in the alloys of this invention if any may vary from about 0.1 to about 0.5 weight percent, more preferably from about 0.1 to about 0.35 weight percent, and even more preferably from about 0.1 to about 0.2 weight percent. The Al—Sc phase diagram shown in FIG. 3 indicates a eutectic reaction at about 0.5 weight percent scandium at about 1219° F. (659° C.) resulting in a solid solution of scandium and aluminum and $Al_3Sc$ dispersoids. Aluminum alloys with less than 0.5 weight percent scandium can be quenched from the melt to retain scandium in solid solution that may precipitate as dispersed $L1_2$ intermetallic $Al_3Sc$ following an aging treatment. Alloys with scandium in excess of the eutectic composition (hypereutectic alloys) can only retain scandium in solid solution by rapid solidification processing (RSP) where cooling rates are in excess of about $10^{3}$° C./second. Alloys with scandium in excess of the eutectic composition cooled normally will have a microstructure consisting of relatively large $Al_3Sc$ grains in a finally divided aluminum-$Al_3Sc$ eutectic phase matrix.

Figure 4:
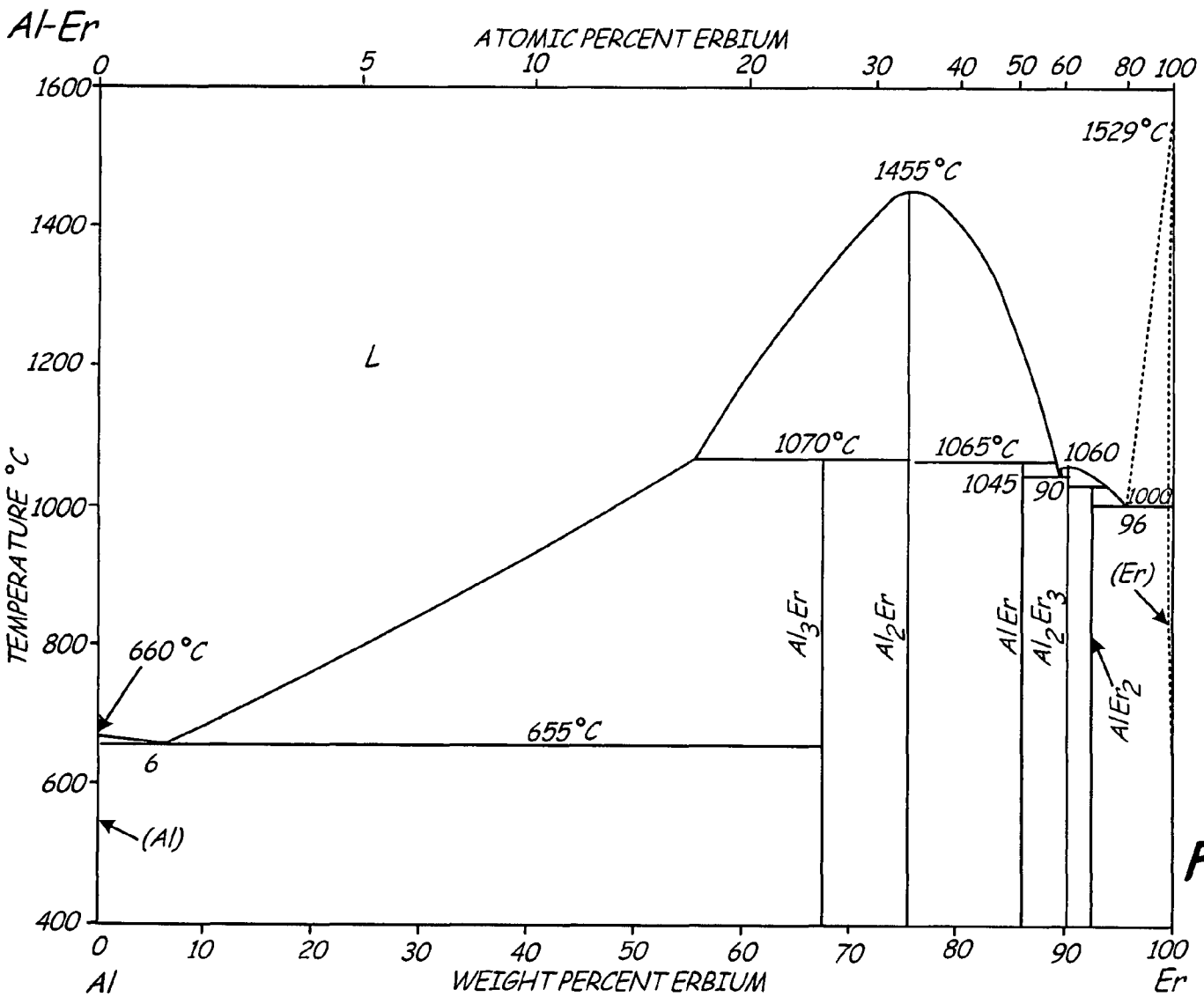
FIG. 4 is an aluminum erbium phase diagram.

The amount of erbium present in the alloys of this invention, if any, may vary from about 0.1 to about 6 weight percent, more preferably from about 0.1 to about 4 weight percent, and even more preferably from about 0.2 to about 2 weight percent. The Al—Er phase diagram shown in FIG. 4 indicates a eutectic reaction at about 6 weight percent erbium at about 1211° F. (655° C.). Aluminum alloys with less than about 6 weight percent erbium can be quenched from the melt to retain erbium in solid solutions that may precipitate as dispersed $L1_2$ intermetallic $Al_3Er$ following an aging treatment. Alloys with erbium in excess of the eutectic composition can only retain erbium in solid solution by rapid solidification processing (RSP) where cooling rates are in excess of about $10^{3}$° C./second. Alloys with erbium in excess of the eutectic composition cooled normally will have a microstructure consisting of relatively large $Al_3Er$ grains in a finely divided aluminum-$Al_3Er$ eutectic phase matrix.

Figure 5:
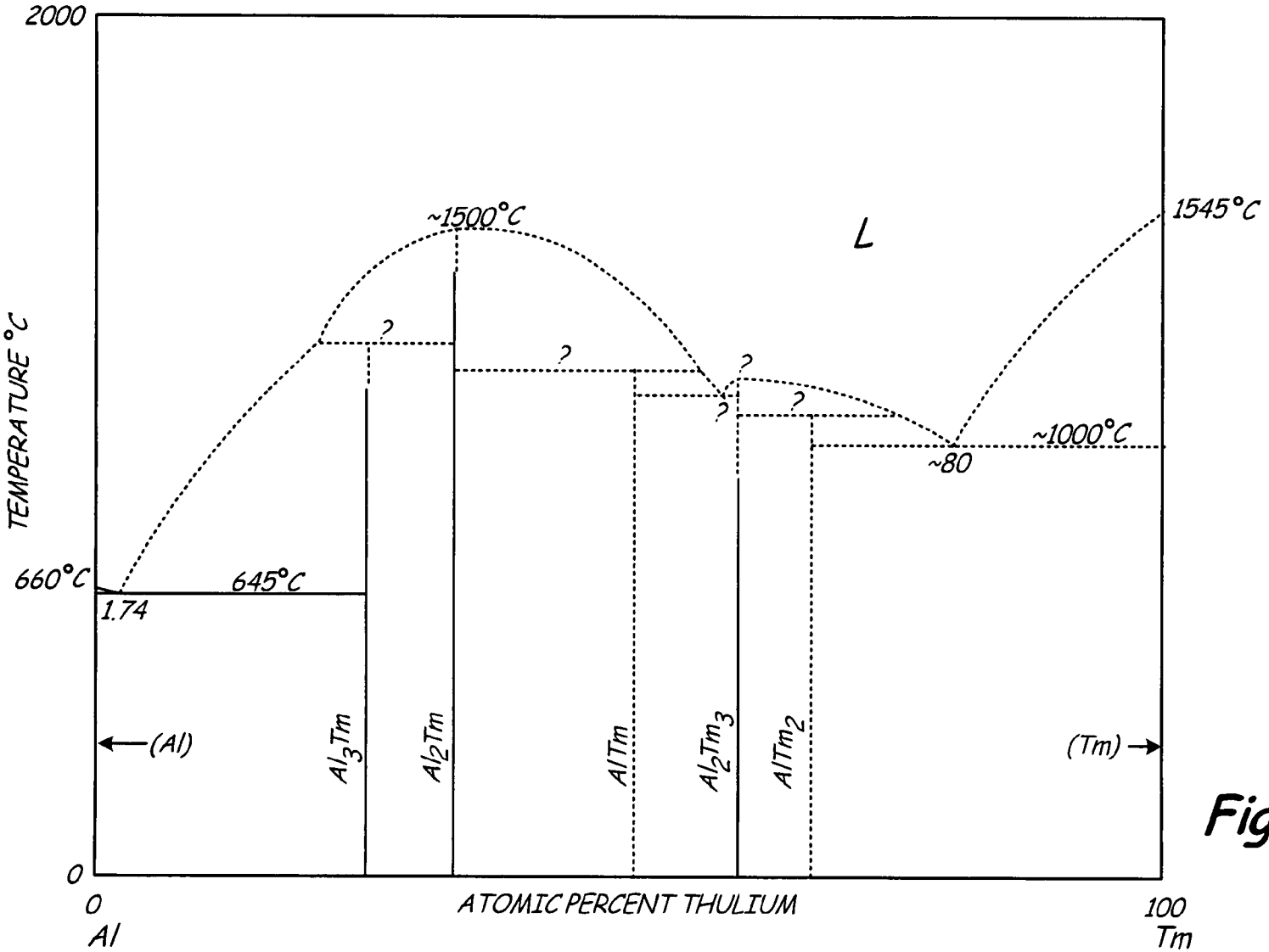
FIG. 5 is an aluminum thulium phase diagram.

The amount of thulium present in the alloys of this invention, if any, may vary from about 0.1 to about 10 weight percent, more preferably from about 0.2 to about 6 weight percent, and even more preferably from about 0.2 to about 4 weight percent. The Al—Tm phase diagram shown in FIG. 5 indicates a eutectic reaction at about 10 weight percent thulium at about 1193° F. (645° C.). Thulium forms metastable $Al_3Tm$ dispersoids in the aluminum matrix that have an $L1_2$ structure in the equilibrium condition. The $Al_3Tm$ dispersoids have a low diffusion coefficient which makes them thermally stable and highly resistant to coarsening. Aluminum alloys with less than 10 weight percent thulium can be quenched from the melt to retain thulium in solid solution that may precipitate as dispersed metastable $L1_2$ intermetallic $Al_3Tm$ following an aging treatment. Alloys with thulium in excess of the eutectic composition can only retain Tm in solid solution by rapid solidification processing (RSP) where cooling rates are in excess of about $10^{3}$° C./second.

Figure 6:
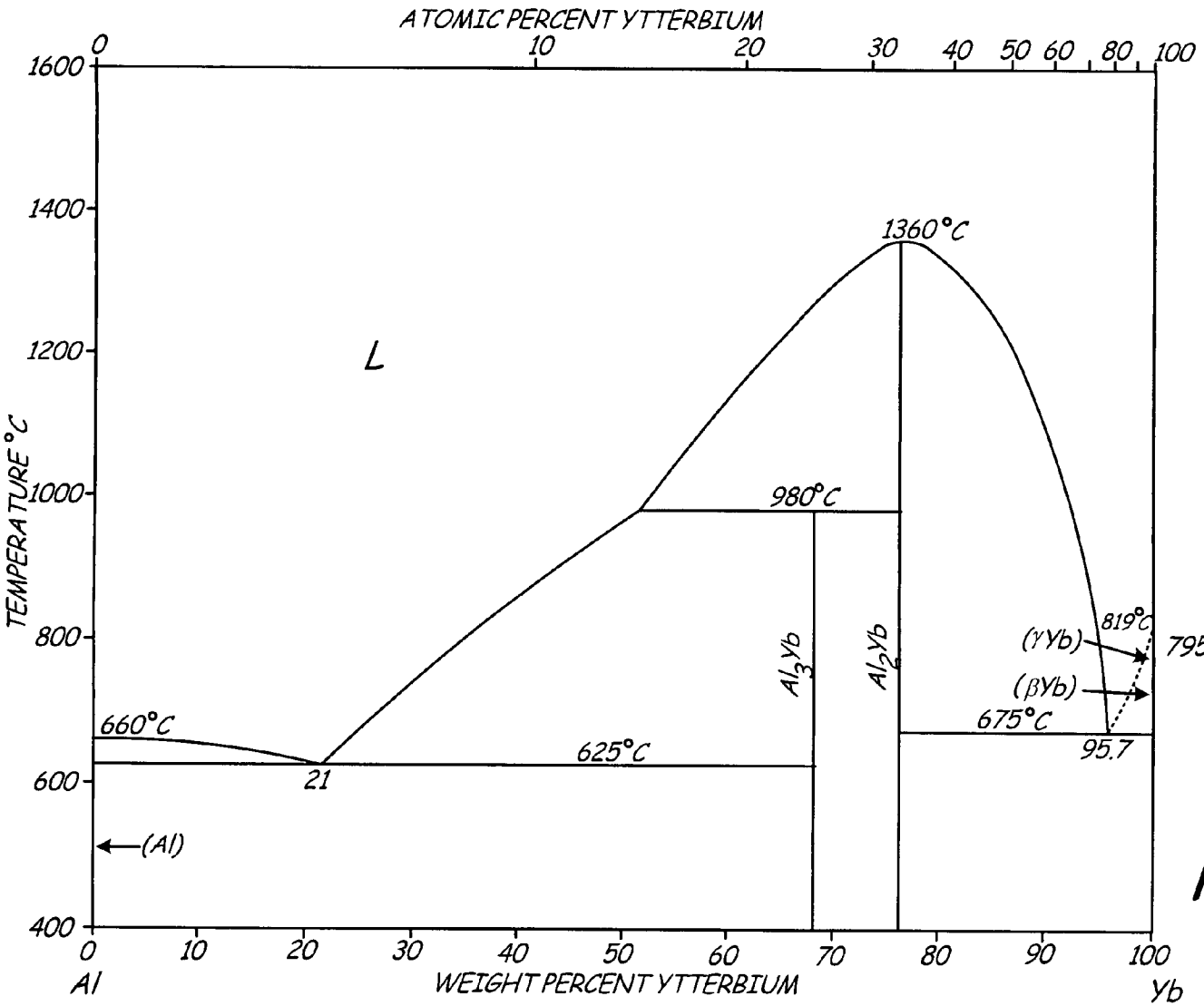
FIG. 6 is an aluminum ytterbium phase diagram.

The amount of ytterbium present in the alloys of this invention, if any, may vary from about 0.1 to about 15 weight percent, more preferably from about 0.2 to about 8 weight percent, and even more preferably from about 0.2 to about 4 weight percent. The Al—Yb phase diagram shown in FIG. 6 indicates a eutectic reaction at about 21 weight percent ytterbium at about 1157° F. (625° C.). Aluminum alloys with less than about 21 weight percent ytterbium can be quenched from the melt to retain ytterbium in solid solution that may precipitate as dispersed $L1_2$ intermetallic $Al_3Yb$ following an aging treatment. Alloys with ytterbium in excess of the eutectic composition can only retain ytterbium in solid solution by rapid solidification processing (RSP) where cooling rates are in excess of about $10^{3}$° C./second.

Figure 7:
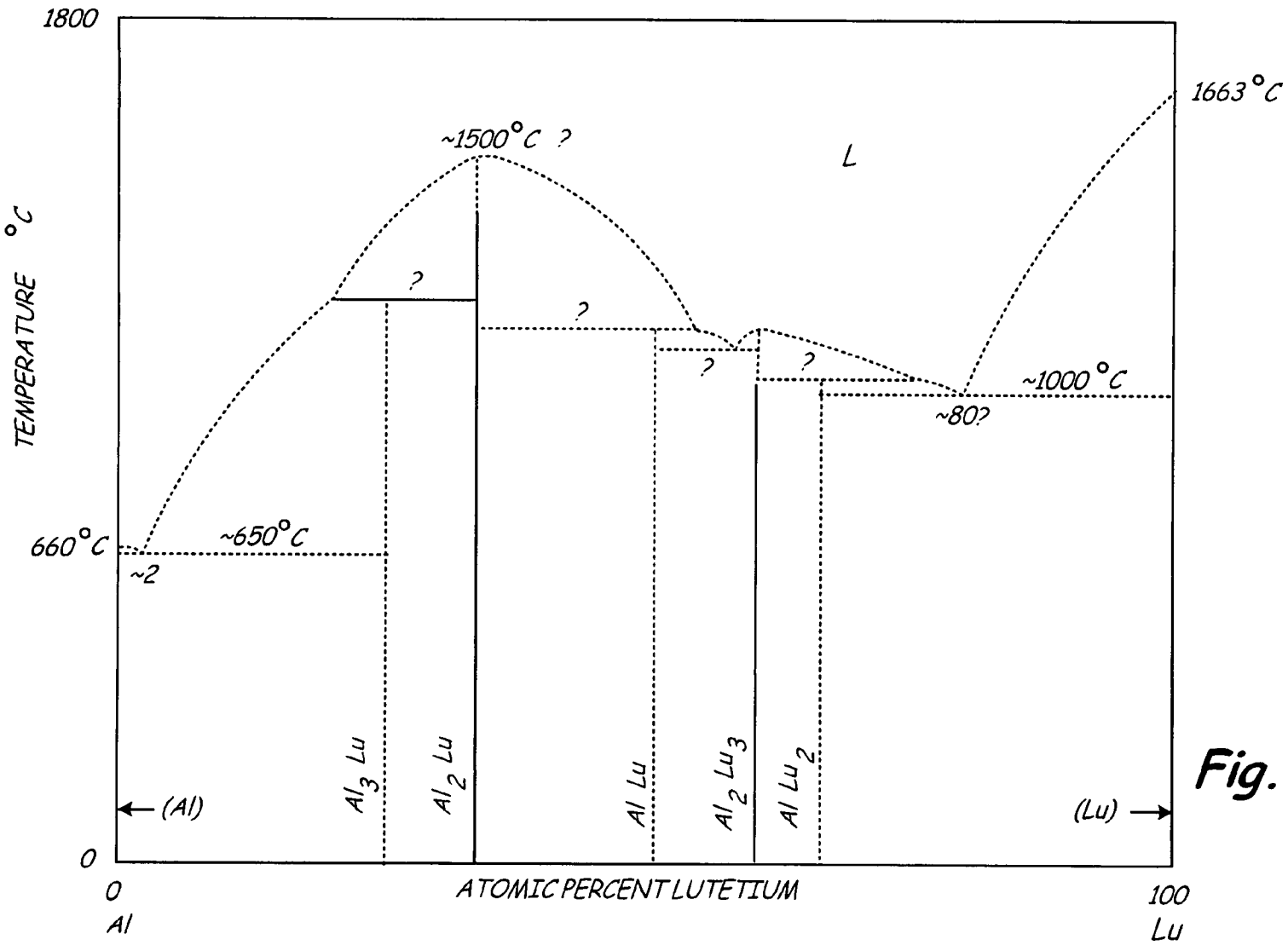
FIG. 7 is an aluminum lutetium phase diagram.

The amount of lutetium present in the alloys of this invention, if any, may vary from about 0.1 to about 12 weight percent, more preferably from about 0.2 to about 8 weight percent, and even more preferably from about 0.2 to about 4 weight percent. The Al—Lu phase diagram shown in FIG. 7 indicates a eutectic reaction at about 11.7 weight percent Lu at about 1202° F. (650° C.). Aluminum alloys with less than about 11.7 weight percent lutetium can be quenched from the melt to retain Lu in solid solution that may precipitate as dispersed $L1_2$ intermetallic $Al_3Lu$ following an aging treatment. Alloys with Lu in excess of the eutectic composition can only retain Lu in solid solution by rapid solidification processing (RSP) where cooling rates are in excess of about $10^{3}$° C./second.

The amount of gadolinium present in the alloys of this invention, if any, may vary from about 0.1 to about 4 weight percent, more preferably from 0.2 to about 2 weight percent, and even more preferably from about 0.5 to about 2 weight percent.

The amount of yttrium present in the alloys of this invention, if any, may vary from about 0.1 to about 4 weight percent, more preferably from 0.2 to about 2 weight percent, and even more preferably from about 0.5 to about 2 weight percent.

The amount of zirconium present in the alloys of this invention, if any, may vary from about 0.05 to about 1 weight percent, more preferably from 0.1 to about 0.75 weight percent, and even more preferably from about 0.1 to about 0.5 weight percent.

The amount of titanium present in the alloys of this invention, if any, may vary from about 0.05 to about 2 weight percent, more preferably from 0.1 to about 1 weight percent, and even more preferably from about 0.1 to about 0.5 weight percent.

The amount of hafnium present in the alloys of this invention, if any, may vary from about 0.05 to about 2 weight percent, more preferably from 0.1 to about 1 weight percent, and even more preferably from about 0.1 to about 0.5 weight percent.

The amount of niobium present in the alloys of this invention, if any, may vary from about 0.05 to about 1 weight percent, more preferably from 0.1 to about 0.75 weight percent, and even more preferably from about 0.1 to about 0.5 weight percent.

The amount of aluminum oxide present in the alloys of this invention, if any, may vary from about 5.0 to about 40 volume percent, more preferably from about 10 to about 30 volume percent, and even more preferably from about 15 to about 25 volume percent. Particle size should range from about 0.5 to about 50 microns, more preferably from about 1.0 to about 20 microns, and even more preferably from about 1.0 to about 10 microns.

The amount of silicon carbide present in the alloys of this invention, if any, may vary from about 5 to about 40 volume percent, more preferably from about 10 to about 30 volume percent, and even more preferably from about 15 to about 25 volume percent. Particle size should range from about 0.5 to about 50 microns, more preferably from about 1.0 to about 20 microns, and even more preferably from about 1.0 to about 10 microns.

The amount of aluminum nitride present in the alloys of this invention, if any, may vary from about 5.0 to about 40 volume percent, more preferably from about 10 to about 30 volume percent, and even more preferably from about 15 to about 25 volume percent. Particle size should range from about 0.5 to about 50 microns, more preferably from about 1 to about 20 microns, and even more preferably from about 1.0 to about 10 microns.

The amount of titanium boride present in the alloys of this invention, if any, may vary from about 5 to about 40 volume percent, more preferably from about 10 to about 30 volume percent, and even more preferably from about 15 to about 25 volume percent. Particle size should range from about 0.5 to about 50 microns, more preferably from about 1 to about 20 microns, and even more preferably from about 1 to about 10 microns.

The amount of titanium diboride present in the alloys of this invention, if any, may vary from about 5.0 to about 40 volume percent, more preferably from about 10 to about 30 volume percent, and even more preferably from about 15 to about 25 volume percent. Particle size should range from about 0.5 to about 50 microns, more preferably from about 1 to about 20 microns, and even more preferably from about 1.0 to about 10 microns.

The amount of titanium carbide present in the alloys of this invention, if any, may vary from about 5 to about 40 volume percent, more preferably from about 10 to about 30 volume percent, and even more preferably from about 15 to about 25 volume percent. Particle size should range from about 0.5 to about 50 microns, more preferably from about 1 to about 20 microns, and even more preferably from about 1 to 10 microns.

In order to have the best properties for the alloys of this invention, it is desirable to limit the amount of other elements. Specific elements that should be reduced or eliminated include no more that about 0.1 weight percent iron, 0.1 weight percent chromium, 0.1 weight percent manganese, 0.1 weight percent vanadium, 0.1 weight percent cobalt, and 0.1 weight percent nickel. The total quantity of additional elements should not exceed about 1% by weight, including the above listed impurities and other elements.

Other additions in the alloys of this invention may include at least one of about 0.001 weight percent to about 0.10 weight percent sodium, about 0.001 weight percent to about 0.10 weight percent calcium, about 0.001 weight percent to about 0.10 weight percent strontium, about 0.001 weight percent to about 0.10 weight percent antimony, about 0.001 weight percent to about 0.10 weight percent barium, and about 0.001 weight percent to about 0.10 weight percent phosphorus. These are added to refine the microstructure of the eutectic phase and the primary magnesium or nickel.

These aluminum alloys may be made by any and all consolidation and fabrication processes known to those in the art such as casting (without further deformation), deformation processing (wrought processing) rapid solidification processing, forging, equi-channel extrusion, rolling, die forging, powder metallurgy and others. The rapid solidification process should have a cooling rate greater that about $10^{3}$° C./second including but not limited to powder processing, atomization, melt spinning, splat quenching, spray deposition, cold spray, plasma spray, laser melting, laser deposition, ball milling and cryomilling. These aluminum alloys may be heat treated. Heat treatment may be accomplished by solution heat treatment at about 800° F. (426° C.) to about 1100° F. (593° C.) for about thirty minutes to four hours followed by quenching and aging at a temperature of about 200° F. (93° C.) to 600° F. (315° C.) for about two to forty-eight hours.

Other exemplary aluminum alloys of this invention include, but are not limited to (in weight percent):

about Al-(3-7.5)Mg-(0.1-0.35)Sc-(0.2-2)Gd-(10-30 vol. %)$Al_2O_3$;
about Al-(3-7.5)Mg-(0.1-4)Er-(0.2-2)Gd-(10-30 vol. %)$Al_2O_3$;
about Al-(3-7.5)Mg-(0.2-6)Tm-(0.2-2)Gd-(10-30 vol. %)$Al_2O_3$;
about Al-(3-7.5)Mg-(0.2-8)Yb-(0.2-2)Gd-(10-30 vol. %)$Al_2O_3$;
about Al-(3-7.5)Mg-(0.2-8)Lu-(0.2-2)Gd-(10-30 vol. %)$Al_2O_3$;
about Al-(3-7.5)Mg-(0.1-0.35)Sc-(0.2-2)Y-(10-30 vol. %)SiC;
about Al-(3-7.5)Mg-(0.1-4)Er-(0.2-2)Y-(10-30 vol. %)SiC;
about Al-(3-7.5)Mg-(0.2-6)Tm-(0.2-2)Y-(10-30 vol. %)SiC;
about Al-(3-7.5)Mg-(0.2-8)Yb-(0.2-2)Y-(10-30 vol. %)SiC;
about Al-(3-7.5)Mg-(0.2-8)Lu-(0.2-2)Y-(10-30 vol. %)SiC;
about Al-(3-7.5)Mg-(0.1-0.35)Sc-(0.1-0.75)Zr-(10-30 vol. %)$B_4C$;
about Al-(3-7.5)Mg-(0.1-4)Er-(0.1-0.75)Zr-(10-30 vol. %)$B_4C$;
about Al-(3-7.5)Mg-(0.1-1.5)Tm-(0.1-0.75)Zr-(10-30 vol. %)$B_4C$;
about Al-(3-7.5)Mg-(0.2-8)Yb-(0.1-0.75)Zr-(10-30 vol. %)$B_4C$;
about Al-(3-7.5)Mg-(0.2-8)Lu-(0.1-0.75)Zr-(10-30 vol. %)$B_4C$;
about Al-(3-7.5)Mg-(0.1-0.35)Sc-(0.1-1)Ti-(10-30 vol. %)TiB;
about Al-(3-7.5)Mg-(0.1-4)Er-(0.1-1)Ti-(10-30 vol. %)TiB;
about Al-(3-7.5)Mg-(0.2-6)Tm-(0.1-1)Ti-(10-30 vol. %)TiB;
about Al-(3-7.5)Mg-(0.2-8)Yb-(0.1-1)Ti-(10-30 vol. %)TiB;
about Al-(3-7.5)Mg-(0.2-8)Lu-(0.1-1)Ti-(10-30 vol. %)TiB;
about Al-(3-7.5)Mg-(0.1-0.35)Sc-(0.1-1)Hf-(10-30 vol. %)AlN;
about Al-(3-7.5)Mg-(0.1-4)Er-(0.1-1)Hf-(10-30 vol. %)AlN;
about Al-(3-7.5)Mg-(0.2-6)Tm-(0.1-1)Hf-(10-30 vol. %)AlN;
about Al-(3-7.5)Mg-(0.2-8)Yb-(0.1-1)Hf-(10-30 vol. %)AlN;
about Al-(3-7.5)Mg-(0.2-8)Lu-(0.1-1)Hf-(10-30 vol. %)AlN;
about Al-(3-7.5)Mg-(0.1-0.35)Sc-(0.1-1)Hf-(10-30 vol. %)TiC;
about Al-(3-7.5)Mg-(0.1-4)Er-(0.1-1)Hf-(10-30 vol. %)TiC;
about Al-(3-7.5)Mg-(0.2-6)Tm-(0.1-1)Hf-(10-30 vol. %)TiC;
about Al-(3-7.5)Mg-(0.2-8)Yb-(0.1-1)Hf-(10-30 vol. %)TiC;
about Al-(3-7.5)Mg-(0.2-8)Lu-(0.1-1)Hf-(10-30 vol. %)TiC;
about Al-(3-7.5)Mg-(0.1-0.35)Sc-(0.05-0.75)Nb-(10-30 vol. %)$TiB_2$;
about Al-(3-7.5)Mg-(0.1-4)Er-(0.05-0.75)Nb-(10-30 vol. %)$TiB_2$;
about Al-(3-7.5)Mg-(0.2-6)Tm-(0.05-0.75)Nb-(10-30 vol. %)$TiB_2$;
about Al-(3-7.5)Mg-(0.2-8)Yb-(0.05-0.75)Nb-(10-30 vol. %)$TiB_2$;
about Al-(3-7.5)Mg-(0.2-8)Lu-(0.05-0.75)Nb-(10-30 vol. %)$TiB_2$;
about Al-(3-9)Ni-(0.1-0.35)Sc-(0.2-2)Gd-(10-30 vol. %)$Al_2O_3$;
about Al-(3-9)Ni-(0.1-4)Er-(0.2-2)Gd-(110-30 vol. %)$Al_2O_3$;
about Al-(3-9)Ni-(0.2-6)Tm-(0.2-2)Gd-(10-30 vol. %)$Al_2O_3$;
about Al-(3-9)Ni-(0.2-8)Yb-(0.2-2)Gd-(10-30 vol. %)$Al_2O_3$;
about Al-(3-9)Ni-(0.2-8)Lu-(0.2-2)Gd-(10-30 vol. %)$Al_2O_3$;
about Al-(3-9)Ni-(0.1-0.35)Sc-(0.2-2)Y-(10-30 vol. %)SiC;
about Al-(3-9)Ni-(0.1-4)Er-(0.2-2)Y-(10-30 vol. %)SiC;
about Al-(3-9)Ni-(0.2-6)Tm-(0.2-2)Y-(10-30 vol. %)SiC;
about Al-(3-9)Ni-(0.2-8)Yb-(0.2-2)Y-(10-30 vol. %)SiC;

about Al-(3-9)Ni-(0.2-8)Lu-(0.2-2)Y-(10-30 vol. %)SiC;

about Al-(3-9)Ni-(0.1-0.35)Sc-(0.1-0.75)Zr-(10-30 vol. %)$B_4C$;

about Al-(3-9)Ni-(0.1-4)Er-(0.1-0.75)Zr-(10-30 vol. %)$B_4C$;

about Al-(3-9)Ni-(0.1-1.5)Tm-(0.1-0.75)Zr-(10-30 vol. %)$B_4C$;

about Al-(3-9)Ni-(0.2-8)Yb-(0.1-0.75)Zr-(10-30 vol. %)$B_4C$;

about Al-(3-9)Ni-(0.2-8)Lu-(0.1-0.75)Zr-(10-30 vol. %)$B_4C$;

about Al-(3-9)Ni-(0.1-0.35)Sc-(0.1-1)Ti-(10-30 vol. %)TiB;

about Al-(3-9)Ni-(0.1-4)Er-(0.1-1)Ti-(10-30 vol. %)TiB;

about Al-(3-9)Ni-(0.2-6)Tm-(0.1-1)Ti-(10-30 vol. %)TiB;

about Al-(3-9)Ni-(0.2-8)Yb-(0.1-1)Ti-(10-30 vol. %)TiB;

about Al-(3-9)Ni-(0.2-8)Lu-(0.1-1)Ti-(10-30 vol. %)TiB;

about Al-(3-9)Ni-(0.1-0.35)Sc-(0.1-1)Hf-(10-30 vol. %)AlN;

about Al-(3-9)Ni-(0.1-4)Er-(0.1-1)Hf-(10-30 vol. %)AlN;

about Al-(3-9)Ni-(0.2-6)Tm-(0.1-1)Hf-(10-30 vol. %)AlN;

about Al-(3-9)Ni-(0.2-8)Yb-(0.1-1)Hf-(10-30 vol. %)AlN;

about Al-(3-9)Ni-(0.2-8)Lu-(0.1-1)Hf-(10-30 vol. %)AlN;

about Al-(3-9)Ni-(0.1-0.35)Sc-(0.1-1)Hf-(10-30 vol. %)TiC;

about Al-(3-9)Ni-(0.1-4)Er-(0.1-1)Hf-(10-30 vol. %)TiC;

about Al-(3-9)Ni-(0.2-6)Tm-(0.1-1)Hf-(10-30 vol. %)TiC;

about Al-(3-9)Ni-(0.2-8)Yb-(0.1-1)Hf-(10-30 vol. %)TiC;

about Al-(3-9)Ni-(0.2-8)Lu-(0.1-1)Hf-(10-30 vol. %)TiC;

about Al-(3-9)Ni-(0.1-0.35)Sc-(0.1-0.75)Nb-(10-30 vol. %)$TiB_2$;

about Al-(3-9)Ni-(0.1-4)Er-(0.1-0.75)Nb-(10-30 vol. %)$TiB_2$;

about Al-(3-9)Ni-(0.2-6)Tm-(0.1-0.75)Nb-(10-30 vol. %)$TiB_2$;

about Al-(3-9)Ni-(0.2-8)Yb-(0.1-0.75)Nb-(10-30 vol. %)$TiB_2$; and about Al-(3-9)Ni-(0.2-8)Lu-(0.1-0.75)Nb-(110-30 vol. %)$TiB_2$.

The alloys may also optionally contain at least one element selected from zinc, copper, lithium and silicon to produce additional precipitation strengthening. The amount of zinc in these alloys ranges from about 3 to about 12 weight percent, more preferably about 4 to about 10 weight percent, and even more preferably about 5 to about 9 weight percent. The amount of copper in these alloys ranges from about 0.2 to about 3 weight percent, more preferably about 0.5 to about 2.5 weight percent, and even more preferably about 1 to about 2.5 weight percent. The amount of lithium in these alloys ranges from about 0.5 to about 3 weight percent, more preferably about 1 to about 2.5 weight percent, and even more preferably about 1 to about 2 weight percent. The amount of silicon in these alloys ranges from about 4 to about 25 weight percent silicon, more preferably about 4 to about 18 weight percent, and even more preferably about 5 to about 11 weight percent.

Even more preferred exemplary aluminum alloys of this invention include, but are not limited to (in weight percent):

about Al-(4-6.5)Mg-(0.1-0.25)Sc-(0.2-2)Gd-(15-25 vol. %)$Al_2O_3$;

about Al-(4-6.5)Mg-(0.2-2)Er-(0.2-2)Gd-(15-25 vol. %)$Al_2O_3$;

about Al-(4-6.5)Mg-(0.2-4)Tm-(0.2-2)Gd-(15-25 vol. %)$Al_2O_3$;

about Al-(4-6.5)Mg-(0.2-4)Yb-(0.2-2)Gd-(15-25 vol. %)$Al_2O_3$;

about Al-(4-6.5)Mg-(0.2-4)Lu-(0.2-2)Gd-(15-25 vol. %)$Al_2O_3$;

about Al-(4-6.5)Mg-(0.1-0.25)Sc-(0.5-2)Y-(15-25 vol. %)SiC;

about Al-(4-6.5)Mg-(0.2-2)Er-(0.5-2)Y-(15-25 vol. %)SiC;

about Al-(4-6.5)Mg-(0.2-4)Tm-(0.5-2)Y-(15-25 vol. %)SiC;

about Al-(4-6.5)Mg-(0.2-4)Yb-(0.5-2)Y-(15-25 vol. %)SiC;

about Al-(4-6.5)Mg-(0.2-4)Lu-(0.5-2)Y-(15-25 vol. %)SiC;

about Al-(4-6.5)Mg-(0.1-0.25)Sc-(0.1-0.5)Zr-(15-25 vol. %)$B_4C$;

about Al-(4-6.5)Mg-(0.2-2)Er-(0.1-0.5)Zr-(15-25 vol. %)$B_4C$;

about Al-(4-6.5)Mg-(0.1-1.5)Tm-(0.1-0.5)Zr-(115-25 vol. %)$B_4C$;

about Al-(4-6.5)Mg-(0.2-4)Yb-(0.1-0.5)Zr-(15-25 vol. %)$B_4C$;

about Al-(4-6.5)Mg-(0.2-4)Lu-(0.1-0.5)Zr-(15-25 vol. %)$B_4C$;

about Al-(4-6.5)Mg-(0.1-0.25)Sc-(0.1-0.5)Ti-(15-25 vol. %)TiB;

about Al-(4-6.5)Mg-(0.2-2)Er-(0.1-0.5)Ti-(15-25 vol. %)TiB;

about Al-(4-6.5)Mg-(0.2-4)Tm-(0.1-0.5)Ti-(15-25 vol. %)TiB;

about Al-(4-6.5)Mg-(0.2-4)Yb-(0.1-0.5)Ti-(15-25 vol. %)TiB;

about Al-(4-6.5)Mg-(0.2-4)Lu-(0.1-0.5)Ti-(15-25 vol. %)TiB;

about Al-(4-6.5)Mg-(0.1-0.25)Sc-(0.1-0.5)Hf-(15-25 vol. %)AlN;

about Al-(4-6.5)Mg-(0.2-2)Er-(0.1-0.5)Hf-(15-25 vol. %)AlN;

about Al-(4-6.5)Mg-(0.2-4)Tm-(0.1-0.5)Hf-(15-25 vol. %)AlN;

about Al-(4-6.5)Mg-(0.2-4)Yb-(0.1-0.5)Hf-(15-25 vol. %)AlN;

about Al-(4-6.5)Mg-(0.2-4)Lu-(0.1-0.5)Hf-(15-25 vol. %)AlN;

about Al-(4-6.5)Mg-(0.1-0.25)Sc-(0.1-0.5)Hf-(15-25 vol. %)TiC;

about Al-(4-6.5)Mg-(0.2-2)Er-(0.1-0.5)Hf-(15-25 vol. %)TiC;

about Al-(4-6.5)Mg-(0.2-4)Tm-(0.1-0.5)Hf-(15-25 vol. %)TiC;

about Al-(4-6.5)Mg-(0.2-4)Yb-(0.1-0.5)Hf-(15-25 vol. %)TiC;

about Al-(4-6.5)Mg-(0.2-4)Lu-(0.1-0.5)Hf-(15-25 vol. %)TiC;

about Al-(4-6.5)Mg-(0.1-0.25)Sc-(0.1-0.5)Nb-(15-25 vol. %)$TiB_2$;

about Al-(4-6.5)Mg-(0.2-2)Er-(0.1-0.5)Nb-(15-25 vol. %)$TiB_2$;

about Al-(4-6.5)Mg-(0.2-4)Tm-(0.1-0.5)Nb-(15-25 vol. %)$TiB_2$;

about Al-(4-6.5)Mg-(0.2-4)Yb-(0.1-0.5)Nb-(15-25 vol. %)$TiB_2$;

about Al-(4-6.5)Mg-(0.2-4)Lu-(0.1-0.5)Nb-(15-25 vol. %)$TiB_2$;

about Al-(4-9)Ni-(0.1-0.25)Sc-(0.2-2)Gd-(15-25 vol. %)$Al_2O_3$;

about Al-(4-9)Ni-(0.2-2)Er-(0.2-2)Gd-(15-25 vol. %)$Al_2O_3$;

about Al-(4-9)Ni-(0.2-4)Tm-(0.2-2)Gd-(15-25 vol. %)$Al_2O_3$;

about Al-(4-9)Ni-(0.2-4)Yb-(0.2-2)Gd-(15-25 vol. %)$Al_2O_3$;

about Al-(4-9)Ni-(0.2-4)Lu-(0.2-2)Gd-(15-25 vol. %)$Al_2O_3$;

about Al-(4-9)Ni-(0.1-0.25)Sc-(0.5-2)Y-(15-25 vol. %)SiC;

about Al-(4-9)Ni-(0.2-2)Er-(0.5-2)Y-(115-25 vol. %)SiC;

about Al-(4-9)Ni-(0.2-4)Tm-(0.5-2)Y-(15-25 vol. %)SiC;

about Al-(4-9)Ni-(0.2-4)Yb-(0.5-2)Y-(15-25 vol. %)SiC;

about Al-(4-9)Ni-(0.2-4)Lu-(0.5-2)Y-(115-25 vol. %)SiC;

about Al-(4-9)Ni-(0.1-0.25)Sc-(0.1-0.5)Zr-(15-25 vol. %)$B_4C$;

about Al-(4-9)Ni-(0.2-2)Er-(0.1-0.5)Zr-(15-25 vol. %)$B_4C$;

about Al-(4-9)Ni-(0.1-1.5)Tm-(0.1-0.5)Zr-(115-25 vol. %)$B_4C$;

about Al-(4-9)Ni-(0.2-4)Yb-(0.1-0.5)Zr-(15-25 vol. %)$B_4C$;

about Al-(4-9)Ni-(0.2-4)Lu-(0.1-0.5)Zr-(15-25 vol. %)$B_4C$;

about Al-(4-9)Ni-(0.1-0.25)Sc-(0.1-0.5)Ti-(15-25 vol. %)TiB;

about Al-(4-9)Ni-(0.2-2)Er-(0.1-0.5)Ti-(15-25 vol. %)TiB;

about Al-(4-9)Ni-(0.2-4)Tm-(0.1-0.5)Ti-(15-25 vol. %)TiB;

about Al-(4-9)Ni-(0.2-4)Yb-(0.1-0.5)Ti-(15-25 vol. %)TiB;

about Al-(4-9)Ni-(0.2-4)Lu-(0.1-0.5)Ti-(15-25 vol. %)TiB;

about Al-(4-9)Ni-(0.1-0.25)Sc-(0.1-0.5)Hf-(15-25 vol. %)AlN;

about Al-(4-9)Ni-(0.2-2)Er-(0.1-0.5)Hf-(15-25 vol. %)AlN;

about Al-(4-9)Ni-(0.2-4)Tm-(0.1-0.5)Hf-(15-25 vol. %)AlN;

about Al-(4-9)Ni-(0.2-4)Yb-(0.1-0.5)Hf-(15-25 vol. %)AlN;

about Al-(4-9)Ni-(0.2-4)Lu-(0.1-0.5)Hf-(15-25 vol. %)AlN;

about Al-(4-9)Ni-(0.1-0.25)Sc-(0.1-0.5)Hf-(15-25 vol. %)TiC;

about Al-(4-9)Ni-(0.2-2)Er-(0.1-0.5)Hf-(15-25 vol. %)TiC;

about Al-(4-9)Ni-(0.2-4)Tm-(0.1-0.5)Hf-(15-25 vol. %)TiC;

about Al-(4-9)Ni-(0.2-4)Yb-(0.1-0.5)Hf-(15-25 vol. %)TiC;

about Al-(4-9)Ni-(0.2-4)Lu-(0.1-0.5)Hf-(15-25 vol. %)TiC;

about Al-(4-9)Ni-(0.1-0.25)Sc-(0.1-0.5)Nb-(15-25 vol. %)$TiB_2$;

about Al-(4-9)Ni-(0.2-2)Er-(0.1-0.5)Nb-(115-25 vol. %)$TiB_2$;

about Al-(4-9)Ni-(0.2-4)Tm-(0.1-0.5)Nb-(115-25 vol. %)$TiB_2$;

about Al-(4-9)Ni-(0.2-4)Yb-(0.1-0.5)Nb-(15-25 vol. %)$TiB_2$; and about Al-(4-9)Ni-(0.2-4)Lu-(0.1-0.5)Nb-(15-25 vol. %)$TiB_2$.

Although the present invention has been described with reference to preferred embodiments, workers skilled in the art will recognize that changes may be made in form and detail without departing from the spirit and scope of the invention.

The invention claimed is:

1. An aluminum alloy having high strength, ductility and toughness, comprising:

about 1 to about 10 weight percent nickel;

at least one first element selected from the group consisting of;

about 0.1 to about 6 weight percent erbium, about 0.1 to about 10 weight percent thulium, about 0.1 to about 15 weight percent ytterbium, and about 0.1 to about 12 weight percent lutetium;

at least one second element selected from the group consisting of: about 0.1 to about 4 weight percent gadolinium, about 0.1 to about 4 weight percent yttrium, about 0.05 to about 2 weight percent titanium, about 0.05 to about 2 weight percent hafnium, and about 0.05 to 1 weight percent niobium;

at least one ceramic selected from the group consisting of: about 5 to about 40 volume percent aluminum oxide, about 5 to about 40 volume percent silicon carbide, about 5 to about 40 volume percent aluminum nitride, about 5 to 40 volume percent titanium diboride, about 5 to about 40 volume percent titanium boride, and about 5 to about 40 volume percent titanium carbide; and the balance substantially aluminum.

2. The alloy of claim 1 further comprising at least one element selected from the group consisting of:

about 3 to about 12 weight percent zinc;

about 0.2 to about 3 weight percent copper;

about 0.5 to about 3 weight percent lithium; and about 4 to about 25 weight percent silicon.

3. The alloy of claim 1, wherein the alloy comprises an aluminum solid solution matrix containing a plurality of dispersed $Al_3X$ second phases having $L1_2$ structures, wherein X includes at least one first element and at least one second element.

4. The alloy of claim 1, comprising no more than about 1 weight percent total impurities.

5. The alloy of claim 1, comprising no more than about 0.1 weight percent iron, about 0.1 weight percent chromium, about 0.1 weight percent manganese, about 0.1 weight percent vanadium, and about 0.1 weight percent cobalt.

6. The alloy of claim 1, which is formed by admixing the ceramic particle reinforcements into a powder comprising the metal, first element, second element and aluminum, and thereafter consolidating the admixture into the alloy.

7. The alloy of claim 1, which is formed by admixing the ceramic particle reinforcements into the molten metal, first element, second element and aluminum using casting process and thereafter pouring the material into a mold to produce the alloy.

8. The alloy of claim 1 further comprising at least one of: about 0.001 to about 0.1 weight percent sodium, about 0.001 to about 0.1 weight percent calcium, about 0.001 to about 0.1weight percent strontium, about 0.001 to about 0.1 weight percent antimony, about 0.001 to about 0.1 weight percent barium, and about 0.001 to about 0.1 weight percent phosphorus.

9. The alloy of claim 1, wherein the alloy is formed by a process comprising at least one of: cryomilling, conventional ball milling, equi-channel extrusion, spray deposition, cold spray and plasma spray.

10. The aluminum alloy of claim 1, wherein the alloy is capable of being used at temperatures from about −420° F. (−251° C.) up to about 650° F. (343° C.).

11. A heat treatable aluminum alloy comprising:

about 1 to about 10 weight percent nickel;

an aluminum solid solution matrix containing a plurality of dispersed $A1_3X$ second phases having $L1_2$ structures where X is selected from the group consisting of at least one of erbium, thulium, ytterbium, and lutetium, and at least one of yttrium, titanium, hafnium, and niobium; and at least one ceramic selected from the group consisting of about 5 to about 40 volume percent aluminum oxide, about 5 to about 40 volume percent silicon carbide, about 5 to about 40 volume percent aluminum nitride, about 5 to about 40 volume percent titanium diboride, about 5 to about 40 volume percent titanium boride, and about 5 to about 40 volume percent titanium carbide; and the balance substantially aluminum.

12. The alloy of claim 11, wherein the alloy comprises at least one of: about 0.1 to about 6 percent erbium, about 0.1 to about 10 wt % thulium, about 0.1 to about 15 weight percent ytterbium, about 0.1 to about 12 weight percent lutetium, about 0.1 to about 4 weight percent yttrium, about 0.05 to about 2 weight percent titanium, about 0.05 to about 2 weight percent hafnium, about 0.05 to about 1 weight percent niobium, about 5 to about 40 volume percent aluminum oxide, about 5 to about 40 volume percent silicon carbide, about 5 to about 40 volume percent aluminum nitride, about 5 to about 40 volume percent titanium diboride, about 5 to about 40 volume percent titanium boride, and about 5 to about 40 volume percent titanium carbide.

13. The alloy of claim 11 further comprising at least one element selected from the group consisting of:

about 3 to about 12 weight percent zinc;

about 0.2 to about 3 weight percent copper;

about 0.5 to about 3 weight percent lithium; and about 4 to about 25 weight percent silicon.

* * * * *